US008489006B2

(12) United States Patent
Ciaschi

(10) Patent No.: US 8,489,006 B2
(45) Date of Patent: Jul. 16, 2013

(54) EXTERNALLY HEATED FUSER DEVICE WITH EXTENDED NIP WIDTH

(75) Inventor: Andrew Ciaschi, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 12/323,495

(22) Filed: Nov. 26, 2008

(65) Prior Publication Data

US 2010/0129122 A1 May 27, 2010

(51) Int. Cl.
*G03G 15/20* (2006.01)

(52) U.S. Cl.
USPC ..... 399/329

(58) Field of Classification Search
USPC ..... 399/329, 320, 328; 219/216, 469–471
See application file for complete search history.

(56) References Cited

U.S. PATENT DOCUMENTS

| | | | | |
|---|---|---|---|---|
| 3,983,287 | A | 9/1976 | Goossen et al. | |
| 4,791,275 | A | 12/1988 | Lee et al. | |
| 4,984,027 | A | 1/1991 | Derimiggio et al. | |
| 5,450,183 | A | 9/1995 | O'Leary | |
| 5,666,624 | A | 9/1997 | Kanesawa et al. | |
| 5,732,318 | A * | 3/1998 | Natsuhara et al. | 399/329 |
| 5,956,543 | A | 9/1999 | Aslam et al. | |
| 6,224,978 | B1 | 5/2001 | Chen et al. | |
| 6,304,740 | B1 * | 10/2001 | Ciaschi et al. | 399/328 |
| 6,445,902 | B1 | 9/2002 | Hirst et al. | |
| 6,521,332 | B2 * | 2/2003 | Ciaschi et al. | |
| 6,611,670 | B2 * | 8/2003 | Chen et al. | 399/328 |
| 6,841,758 | B2 * | 1/2005 | Eskey | 219/216 |
| 6,961,533 | B2 * | 11/2005 | Sano et al. | 219/216 |
| 7,107,001 | B2 | 9/2006 | Kameda | |
| 7,155,136 | B2 | 12/2006 | Nihonyanagi et al. | |
| 7,162,194 | B2 | 1/2007 | Hotta | |
| 7,190,914 | B2 | 3/2007 | Nihonyanagi et al. | |
| 7,224,922 | B2 | 5/2007 | Kemmochi | |
| 7,251,427 | B2 | 7/2007 | Nanataki et al. | |
| 7,263,303 | B2 | 8/2007 | Nakayama | |
| 7,272,352 | B2 | 9/2007 | Kodama | |
| 7,546,078 | B2 * | 6/2009 | Okuda et al. | 399/329 |
| 7,881,650 | B2 * | 2/2011 | Shin et al. | 399/329 |
| 7,917,074 | B2 * | 3/2011 | Takada | 399/329 |
| 2002/0172536 | A1 * | 11/2002 | Hirst et al. | 399/328 |
| 2005/0025537 | A1 * | 2/2005 | Echigo et al. | 399/329 |
| 2005/0169679 | A1 * | 8/2005 | Uchiyama et al. | 399/328 |

(Continued)

FOREIGN PATENT DOCUMENTS

| | | | |
|---|---|---|---|
| EP | 1 376 263 | A2 | 1/2004 |
| EP | 1 569 047 | A2 | 8/2005 |
| JP | 10319752 | A * | 12/1998 |

*Primary Examiner* — Susan Lee
(74) *Attorney, Agent, or Firm* — Roland R. Schindler, II

(57) ABSTRACT

A fuser device for an electrostatographic reproduction apparatus. The fuser device includes an externally heated fuser roller having a thick elastomeric cover. An external heater assembly is positioned in operative association with the fuser roller. The external heater assembly has a low mass, fast-acting heating element to transfer heat rapidly to and from the external surface of the elastomeric cover of the fuser roller. A pressure film belt assembly is also in operative association with the fuser roller, spaced from the external heater assembly. The pressure film belt assembly has a pressure applicator which maximizes thermal contact and mechanical energy to define an optimum nip pressure profile providing an extended fusing nip with the fuser roller, thereby yielding quick starting, with superior energy efficiency and exceptional temperature control for the fuser device that provides proper image quality for photos, text, and graphics for high quality reproductions with consistent gloss (luster).

4 Claims, 8 Drawing Sheets

U.S. PATENT DOCUMENTS

2006/0285896 A1* 12/2006 Beach et al.
2007/0092313 A1* 4/2007 Kim et al. ..... 399/329
2007/0217838 A1* 9/2007 Yamana et al. ..... 399/328
2007/0264059 A1* 11/2007 Maeda et al. ..... 399/320
2008/0273904 A1* 11/2008 Nishida et al.
2009/0074486 A1* 3/2009 Takada ..... 399/329
2009/0110450 A1* 4/2009 Barton et al. ..... 399/329

* cited by examiner

EXTERNALLY HEATED FUSER DEVICE WITH EXTENDED NIP WIDTH

FIELD OF THE INVENTION

This invention relates in general to an electrostatographic printing apparatus having a fuser device for permanently fixing toner powder particle images to receiver media, and more particularly to a fuser device having an on demand externally heated fuser with an extended nip width.

BACKGROUND OF THE INVENTION

In electostatographic imaging and recording processes such as electrophotographic reproduction, an electrostatic latent image is formed on a primary image-forming member such as a dielectric surface and is developed with a thermoplastic toner powder to form a visible image. The visible thermoplastic toner powder image is thereafter transferred to a receiver, e.g., a sheet of paper or plastic, and the visible thermoplastic toner powder image is subsequently fused to the receiver in a fusing station using heat or pressure, or both heat and pressure. The fuser station can include a roller, belt or any surface having a suitable shape for fixing thermoplastic toner powder to the receiver.

The fusing operation with a roller fuser commonly comprises passing the image-bearing receiver between a pair of engaged rollers that produce an area of pressure contact known as a fusing nip. In order to form the fusing nip, at least one of the rollers typically has a compliant or conformable layer on its surface. Heat is transferred from at least one of the rollers to the visible thermoplastic toner powder in the fusing nip, causing the toner powder to partially melt and attach to the receiver. In the case where the fuser member is a heated mller, a resilient compliant layer having a smooth surface is typically used which is bonded either directly or indirectly to the core of the roller. Where the fuser member is in the form of a belt, e.g., a flexible endless belt that passes around the heated roller, the belt typically has a smooth, hardened outer surface.

Two basic types of heated roller fusers have evolved. One uses a conformable or compliant pressure roller to form the fusing nip against a hard fuser roller. The other uses a compliant fuser roller to form the nip against a hard or relatively non-conformable pressure roller. A fuser roller designated herein as compliant typically includes a conformable layer having a thickness greater than about 2 mm and in some cases exceeding 25 mm. A fuser roller designated herein as hard includes a rigid cylinder, which may have a relatively thin polymeric or conformable coating, typically less than about 1.25 mm thick. A compliant fuser roller used in conjunction with a hard pressure roller tends to provide easier release of a receiver from the heated fuser roller, because the distorted shape of the compliant surface in the nip tends to bend the receiver towards the relatively non-conformable pressure roller and away from the much more conformable fuser roller.

One common type of fuser roller is internally heated, i.e., a source of heat for fusing is provided within the roller for fusing. Such a fuser roller normally has a hollow core, inside of which is located a heating source, usually a lamp. Surrounding the core is an layer through which heat is conducted from the core to the surface, and the elastomeric layer typically contains fillers for enhanced thermal conductivity. A different kind of fuser roller, which is internally heated near its surface, is disclosed by Lee et al. in U.S. Pat. No. 4,791,275, which describes a fuser roller including two polyimide Kapton® sheets (sold by DuPont® and Nemours) having a flexible ohmic heating element disposed between the sheets. The polyimide sheets surround a conformable polyimide foam layer attached to a core member. According to J. H. DuBois and F. W. John, Eds., in Plastics, 5th Edition, Van Nostrand and Rheinhold, 1974, polyimide at room temperature is fairly stiff with a Youngs modulus of about 3.5 GPa-5.5 GPa (1 GPa=1 GigaPascal=10.sup.9 Newton/m.sup.2), but the Young's modulus of the polyimide sheets can be expected to be considerably lower at the stated high operational fusing temperature of the roller of at least 450 degrees F.

Another common type of fuser roller is an externally heated fuser roller. The externally heated fuser roller is heated by surface contact between the fuser roller and one or more external heating rollers. Externally heated fuser rollers are disclosed by O'Leary, U.S. Pat. No. 5,450,183, and by Derimiggio et al., U.S. Pat. No. 4,984,027.

A compliant fuser roller may include a conformable layer of any useful material, such as for example a substantially incompressible elastomer, i.e., having a Poisson's ratio approaching 0.5. A substantially incompressible conformable layer including a poly(dimethyl siloxane) elastomer has been disclosed by Chen et al., in the commonly assigned U.S. Pat. No. 6,224,978, which is hereby incorporated by reference. Alternatively, the conformable layer may include a relatively compressible foam having a value of Poisson's ratio much lower than 0.5. A conformable polyimide foam layer is disclosed by Lee in U.S. Pat. No. 4,791,275 and a lithographic printing blanket are disclosed by Goosen et al. in U.S. Pat. No. 3,983,287, including a conformable layer containing a vast number of frangible rigid-walled tiny bubbles, which are mechanically ruptured to produce a closed cell foam having a smooth surface.

Receivers remove the majority of heat during fusing. Since receivers may have a narrower length measured parallel to the fuser roller axis than the fuser roller length, heat may be removed differentially, causing areas of higher temperature or lower temperature along the fuser roller surface parallel to the roller axis. Higher or lower temperatures can cause excessive toner offset (i.e., toner powder transfer to the fuser roller) in roller fusers.

In the fusing of the toner image to the receiver, the area of contact of a conformable fuser roller with the toner-bearing surface of a receiver sheet as it passes through the fusing nip is determined by the amount pressure exerted by the pressure roller and by the characteristics of the resilient conformable layer. The extent of the contact area helps establish the length of time that any given portion of the toner image will be in contact with, and heated by, the fuser roller.

In a roller fusing system, the fusing parameters, namely the temperature, nip-width, and speed of the fusing member, are fixed and controlled within certain specifications for a given range of receivers. Generally the system changes the temperature or/and speed according to the receiver weights or types. The changing of temperature in an internally heated fuser roller takes time to stabilize. If the receivers are presented at a too-rapid rate, the fuser roller may not have returned to its working temperature when the next receiver arrives. Consequently, the receivers must be stopped or slowed until the temperature of the fuser roller has come within acceptable range and such stopping or slowing results in degradation of receiver throughput rate. The same is true for speed changes. Regardless of whether the speed of presentation or the fuser roller temperature itself is being adjusted by the system, the temperature stabilization time required by a fusing member can constrain the speed of presentation of receivers.

The fixing quality of toned images of an electrophotographic printer depends on the temperature, nip-width, process speed, and thermal properties of the fusing member, toner chemistry, toner coverage, and receiver type. To simplify the engineering and control of a roller fusing system, as many as possible of the above parameters are considered and then fixed during the system's design. The fusing parameters such as temperature, nip-width, process speed, and thermal properties of the fusing member are optimized for the most critical case.

Complicating the systems design is the fact that the toner coverage and the receiver type (weight, coated/uncoated) can vary from image to image in a digital printer. Therefore, some of the above listed parameters need to be adjusted according to the image contents and the receiver types to assure adequate image fixing. Typically, the fuser temperature is adjusted and kept constant for a dedicated run with a particular receiver. The temperature is adjusted higher from the nominal for heavier receivers and lower for lighter receivers. For some heavy receivers, the speed must also be reduced.

The change of fusing speed results in reduced productivity. The change in fusing temperature can also result in reduced productivity because of time spent waiting for the fusing member temperature to change. Furthermore, if different receiver types are required in a single document extra time is needed to collate images on different receivers into the document.

A digital printer with multiple paper supplies allows running RIPPED information that varies from image to image onto multiple receivers in a single document run. Since the RIPPED image may vary from one occurrence to the next both in image color and image density, the workload on the fuser may vary significantly. U.S. Pat. No. 5,956,543, issued to Aslam et al. optimizes the image fixing of toned images on a specified receiver by optimally selecting the fuser temperature, nip-width and speed. However, it does not address the image fixing quality issues when multiple types and weights of receivers are mixed during a document mode operation of an electrophotographic printer.

Another complication with known roller fuser apparatus for high image quality color reproduction involves minimizing gloss variances, while maximizing thermal efficiency to achieve proper application dependent gloss level for the desired reproduction. For achieving high levels of gloss, common control techniques involve maximizing the fuser nip width and the pressure-time relationship of the image-bearing receiver in the fuser nip. In order to provide the proper image quality desired in the market today, image gloss (i.e., luster) control of the fuser has become more important. The ability to match the receiver surface gloss at all image color densities (which implies no differential gloss within a page, or from page to page), as closely as possible, substantially effects and determines the level of image quality with respect to the fusing process operation. The optimal gloss result would be to have no change in gloss within a reproduction page from lead to trail edge, and to have no change in gloss from receiver to receiver in short or long reproduction run jobs.

The fusing surfaces in the fusing nip need to maintain a constant temperature throughout the fusing process to maintain consistent gloss across the entire toner powder image. When a gloss of about 30 G60 units or higher is achieved, gloss variations within the image become more noticeable to the human eye, and the need for improved temperature control is required. Internally heated fuser rollers have a certain time constant for heat to reach the fusing nip surface. The longer the time constant the more difficult it is to maintain a constant fusing temperature, and the temperature range of oscillation increases.

In addition, to attain a high gloss (about 30 G60 units or higher), a relatively large heating (fusing) dwell time is required. Current commercial fusing technology, using low viscosity polyester tones, require a fusing nip dwell time of about 65 milliseconds or greater. Thus, for a 30 page per minute fusing process, the nip width would need to be about 8.5 nm, and for a 60 page per minute fusing process the nip width would need to be about 17.0 mm. To create sc nip widths with rollers, large diameter rollers (2.5 inches to 3.5 inches or larger) with thick elastomer base cushions would be required. Such configuration inherently posses a large thermal mass. Internal heating of the fuser rollers would have a large time constant, and would result in slow heating and difficult temperature control. There would also be significant environmental heating which constitutes substantial wasted energy.

SUMMARY OF THE INVENTION

The invention is directed to a fuser device for an electrostatographic reproduction apparatus. The fuser device includes an externally heated fuser roller. An external heater film assembly is positioned in operative association with the fuser roller. The external heater film assembly has a low mass fast-acting heating element to transfer heat rapidly to and from the external surface of the fuser roller. A pressure film belt assembly is also in operative association with the fuser roller, spaced from the external film assembly. The pressure film belt assembly has a pressure applicator which maximizes thermal contact and mechanical energy to define an optimum nip pressure profile providing an extended fusing nip with the fuser roller, thereby yielding quick starting, with superior energy efficiency and exceptional temperature control for the fuser device that provides proper image quality for photos, text, and graphics for high quality reproductions with consistent gloss (luster).

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
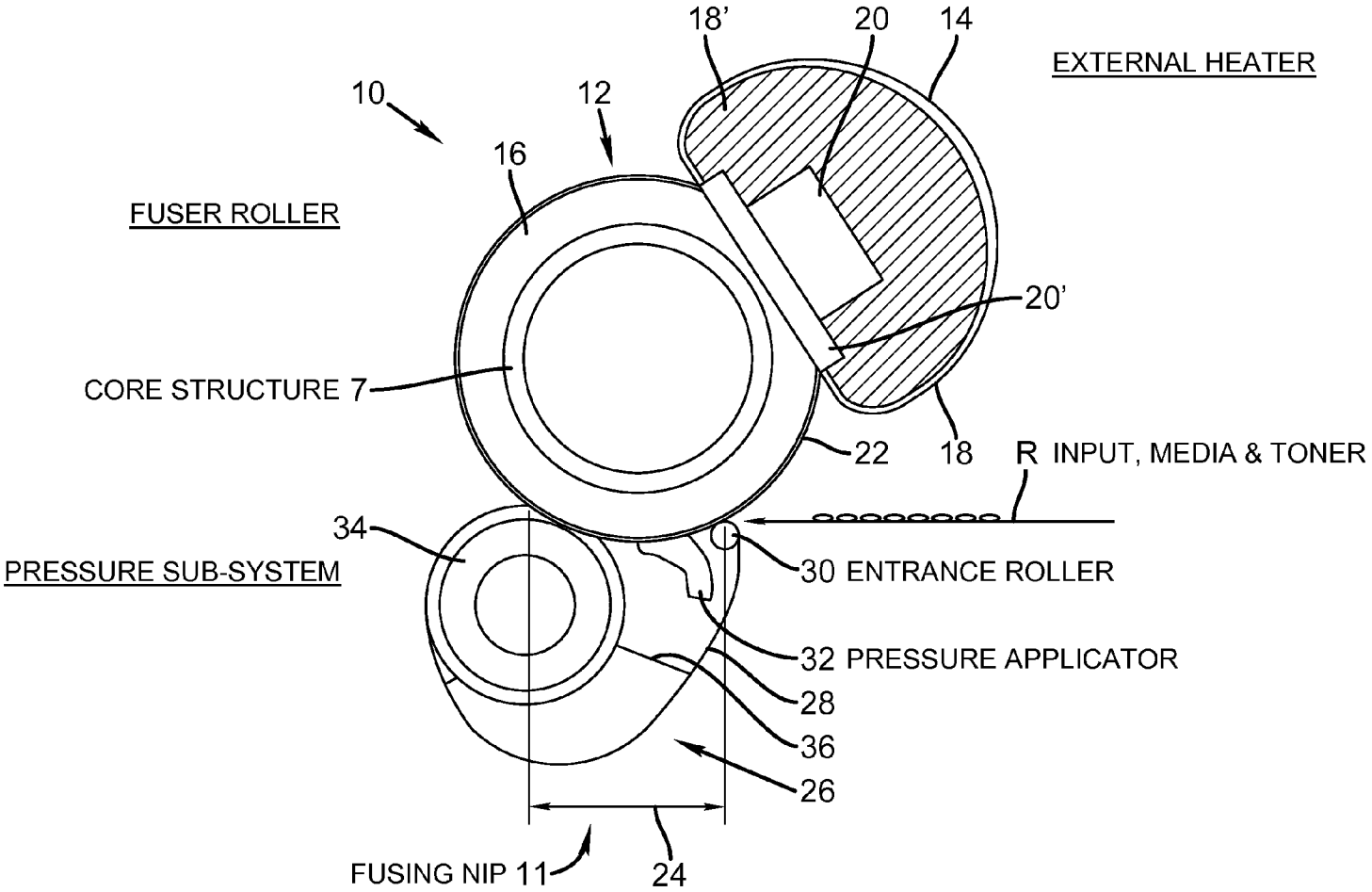
FIG. 1 shows a schematic of the fuser device according to this invention.

The fuser device, according to this invention, is shown in FIG. 1 and is generally designated by the numeral 10. The fuser device 10, to be utilized in any well known electrostatographic reproduction apparatus (not shown), basically includes a fusing roller 12 selectively rotated at a predetermined speed, an external heater assembly 14, and a pressure nip-forming backup film and support structure assembly 26. The fuser device 10 may be controlled by reproduction apparatus intelligence in any well known manner. For example, the fuser process set-points (fuser nip width, fuser temperature, and energy requirements) for various types of receiver media may be stored as lookup tables in a media catalog for a machine control unit. The receiver media can include heavy stock cover material, interior page print material, insert material, transparency material, or any other desired media to carry text or image information.

A typical machine control unit includes a microprocessor and memory or microcomputer. It stores and operates a program that controls operation of the reproduction apparatus (including the fuser device) in accordance with programmed steps and machine inputs, such as temperature of the fuser roller. Temperature data is supplied, for example, by a thermocouple or any other suitable thermal sensor in a manner well known to those skilled in the art. As a sheet of a specific media bye is requested, a data signal to the machine control unit (or alternatively, directly to an independent control for the fuser device) that is representative of the image contents and the type of media sheet to be fixed in the fuser device. The machine control unit sets the fuser conditions (temperature; dwell time) from the media catalog as a function of the data provided. The machine control unit directs the heating nip width control according to the power requirements of the fuser roller per the information provided from media catalog. The machine control unit also directs the fuser roller nip width controller to adjust the fuser nip per the information provided from media catalog.

The fuser roller 12 of the fuser device 10 includes, for example, an aluminum core 7, a relatively thick elastomeric base-cushion 16 (5 to 10 mils thick depending on the process speed), and a thin top release coating layer 22 (1 to 2 mils thick). The external heater assembly 14 includes an endless metal film 18. The film 18 is internally heated by a low mass heating element 20, such as for example, a metal resistance trace embedded in a ceramic substrate operating on a the Joule heating principle such that heat transfer is purely diffusive. Thus heat generated in the heating element 20 is transferred to the film 18 by thermal diffusion. The film 18 is urged into selective pressure relation with the polymer release layer 22 of the fusing roller 12 by the heating element 20 to form a heating nip 20'. The heating film 18 then transfers heat to the external surface of the fusing roller 12 in the heating nip 20' by thermal diffusion. Such heat is then transferred, by thermal diffusion, to image-wise toner powder particles carried by a receiver media sheet (for example sheet R) transported to the fuser device 10 in any well known manner (not shown).

Figure 3:
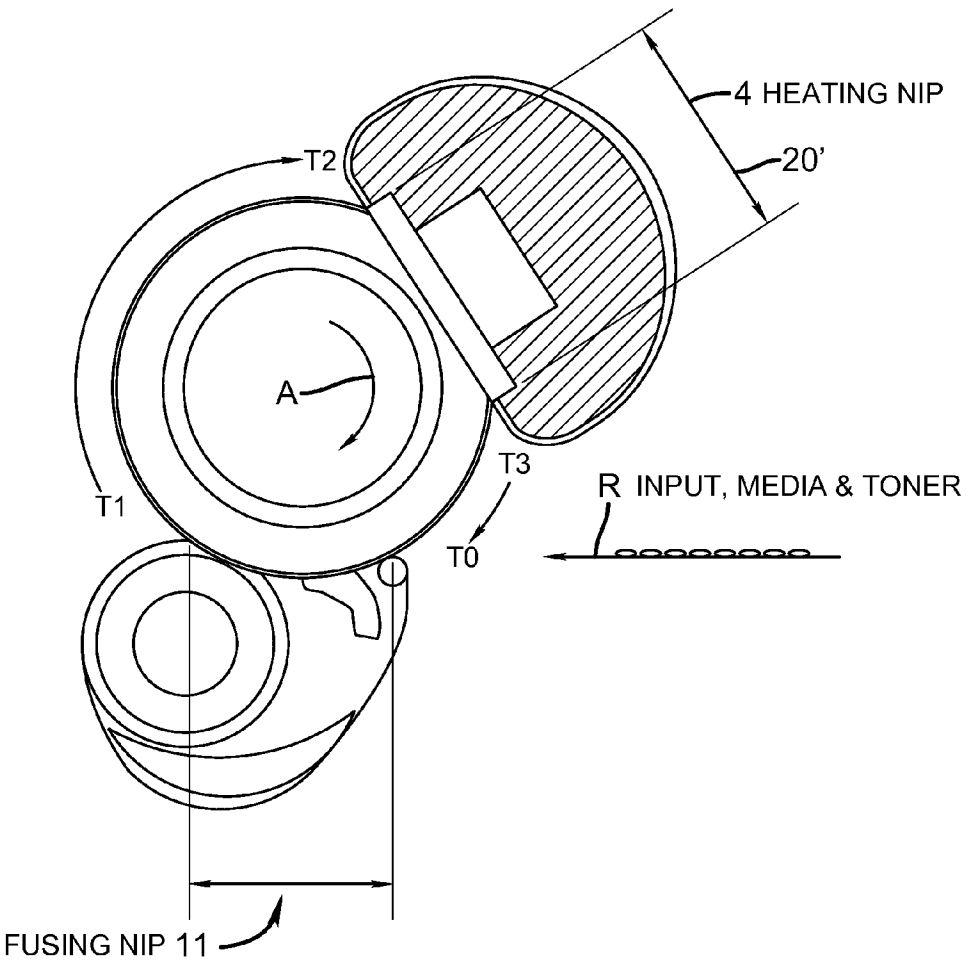
FIG. 3 shows the temperature points around the fuser roller for the fuser device of FIG. 1.

The image-wise toner powder particles on a receiver media sheet R and the sheet are pressed between the release layer 22 of the fusing roller 12 and the pressure film assembly 26 in a fusing nip 24 as the fuser roller 12 is rotated, in any well known controlled manner in the direction of arrow A (see FIG. 3). The amount of energy transferred to the toner powder and receiver media sheet is dependent on the resident (dwell) time of the receiver media sheet in the fusing nip 24. Using a pressure film assembly 26 to create an extended fusing nip 24 (as compared with a pressure roller such as well known in the art) provides a long resident time required for high quality surface finishes on receiver media where medium to high gloss is desired.

The pressure film assembly 26 includes an endless pressure film belt 28. An entrance roller 30 about which the pressure film belt 28 is wrapped establishes an entrance guide for transporting a toner powder bearing receiver media sheet R into the fusing nip 24. A pressure applicator 32 is provided within the pressure film belt endless path for applying a preselected pressure to urge the pressure film belt 28 into operative contact with the fusing roller 12. An exit roller 34 within the pressure film belt endless path supports the pressure film belt 28 to apply contact pressure of the pressure film belt to the fusing roller 12, and further creates a mechanical release feature at an exit of the fusing nip 24. A tracking structure 36, also located within the path of the pressure film belt 28, about which the pressure film belt 28 is wrapped, serves to guide the pressure film belt 28 in the desired path relative to the fusing roller 12. With such pressure film assembly 26, a toner powder bearing receiver media sheet R is guided through the fusing nip 24 at a desired pressure and with a desired dwell time in the fusing nip.

Externally heating the surface of the fusing roller 12 with the external heater 14 is the fastest way to bring the surface temperature of the fusing roller 12 up to a required fusing temperature. Using a thick fuser roller elastomer cover 16 enables attaining a large fusing nip 24. The larger the fusing nip, the longer the fusing dwell time for achieving a high level of gloss. Externally heating the fusing roller 12, with a thick elastomeric cover 16 greatly reduces the time constant to heat the fusing surface (as opposed to internally heating the fuser roller). For example, see Table 1 in which an internally heated fuser roller with a 5 mm red silicone elastomeric cover and a 6.35 mm thick aluminum 6061-T6 core structure is compared to a similarly constructed fuser roller externally heated with a 50 micron thick Nickel film belt.

TABLE 1

THERMAL TIME CONSTANT COMPARISON
Table 1: Thermal Time Constant Comparison

| $\tau = \rho C_p t^2/k$ | External Heating | Internal Heating |
|---|---|---|
| $\tau$-1$^{st}$ Layer, seconds | $168.2 \times 10^{-6}$ | 0.588 |
| $\tau$-2$^{nd}$ Layer, seconds | N/A | 84.9 |
| $\tau$-Total, seconds | $168.2 \times 10^{-6}$ | 85.5 |

$\tau$ ≡ Thermal time constant, seconds
$\rho$ ≡ Mass density
$C_p$ ≡ Specific heat
t ≡ Layer thickness
k ≡ Thermal conductivity Table 1 shows the mathematical relationship for the thermal time constant based on conductive heat transfer (thermal diffusion). The first layer is heated by the appropriate heating element, the second layer is heated by contact conduction from the first layer. With the externally heated roller case, only one layer (the heating film 18) is provided. The total time constant is shown in the last row of the table. The externally heated fuser roller has a thermal time constant that is than a millisecond, whereas the internally heated fusing roller has a time constant of approximately 85 seconds. The smaller time constant of the externally heated fuser roller is significant, and would result in substantially faster heating times, faster cooling times, less environmental heating (waste heat), and more constant temperature control response.

The above described time constant is not the only heating factor. The dwell time in the fuser nip 24 is also a significant factor. The dwell time in the fuser nip 24 is a function of the speed of rotation of the fusing roller 12 and the fusing nip width 11. The longer the fusing nip width, at a given fusing roller surface velocity results in longer dwell times. FIG. 3 shows the temperature points around the surface of the fusing roller 12. T0 to T1 is the fusing nip, T1 to T2 is the cooling span, and T2 to T3 is the heating nip. To optimize the change in temperature from T2 to T3, the longest possible dwell time and the highest possible heating film 18 temperature should be used. Maximizing the nip width is accomplished by shaping the tracking structure 18' for the heating film 18 and the heating element 20 so as to be at least substantially flat or concave, and pressing the heating element 20, through the heating belt 18, against the fusing roller 12 with sufficient force (pressure).

As discussed above, the width of the fuser nip 24 and the rotational speed of the fusing roller 12 define the fusing dwell time. Further, the pressure profile in the fuser nip 24 (see FIG. 5) defines the contact thermal conductance, in addition to the mechanical work necessary to cause the toner powder particles to sinter together for fixing to the receiver media sheet and flow for gloss level control. To maximize the fusing dwell time, the pressure film belt 28 is supported in the endless travel path by the entrance roller 30, the pressure applicator 32, the exit roller 34, and the tracking structure 36. The exit roller 34 forces the exiting receiver media sheet R off the fuser roller 12 with the pressure film belt 28, a mechanical release process well known in the art. To accomplish this end, the exit roller 34 needs to be smaller in diameter, or posses a stiffer elastomeric cover than the fuser roller 12 to provide the proper fusing nip exit geometry for good consistent release of the receiver media sheet from the fuser roller 12. If the release is not consistent the gloss level will vary due to an inconsistent point of release from the fusing roller 12, which causes a variability in dwell time. Utilizing the described pressure film assembly 26 enables the fusing nip width to be extended by adjusting, and controlling, the contact length (and area) of the pressure film belt 28 and the fuser roller 12. The contact length adjustment is provided by positioning the exit roller 34 and the entrance roller 30 with respect to each other and the fuser roller 12.

Figure 2:
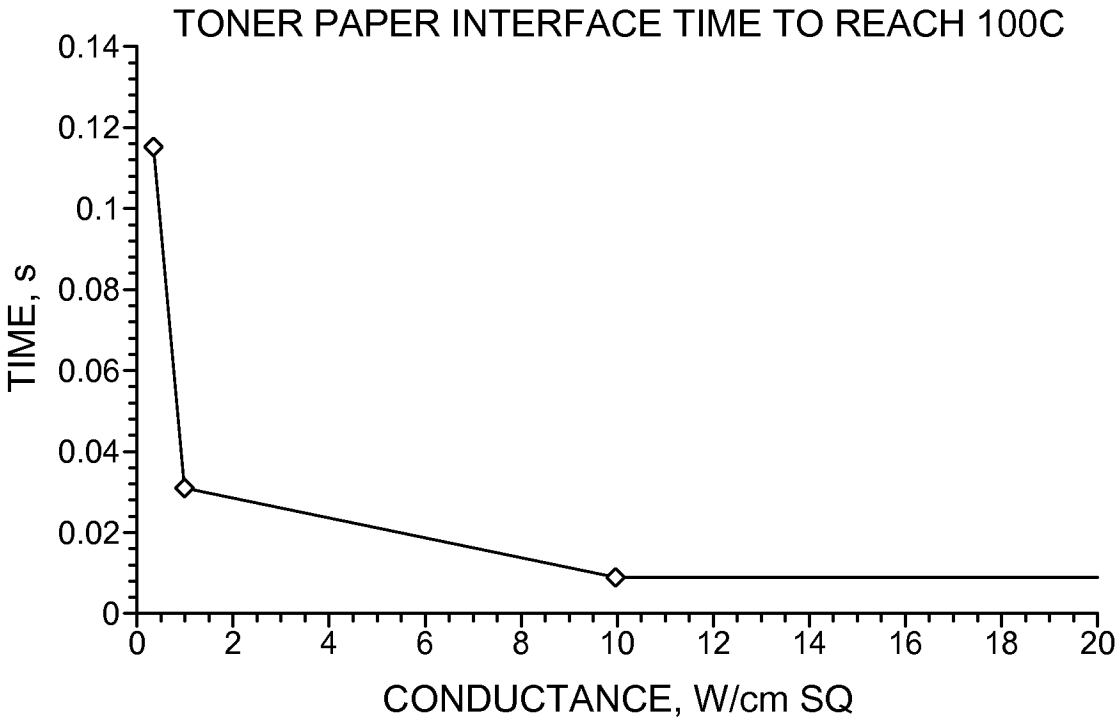
FIG. 2 is a graphical representation showing the time to reach 100° C. by plotting the time vs. conductance.

Optimizing the pressure in the fusing nip 24, by maximizing the pressure throughout the nip while maintaining good sheet handling characteristics, will maximize the thermal contact conductance between the surface of the fuser roller 12 and the receiver media sheet and the image-wise toner powder particles on the receiver media sheet. FIG. 2 shows a general relationship between thermal conductance and thermal response time, in this instance to reach 100 degrees C. As the thermal conductance increases, the thermal response time decreases. To have a faster response time, the thermal conductance should be maximized knowing that the thermal conductance increases with increasing pressure in the fusing nip.

Figure 4:
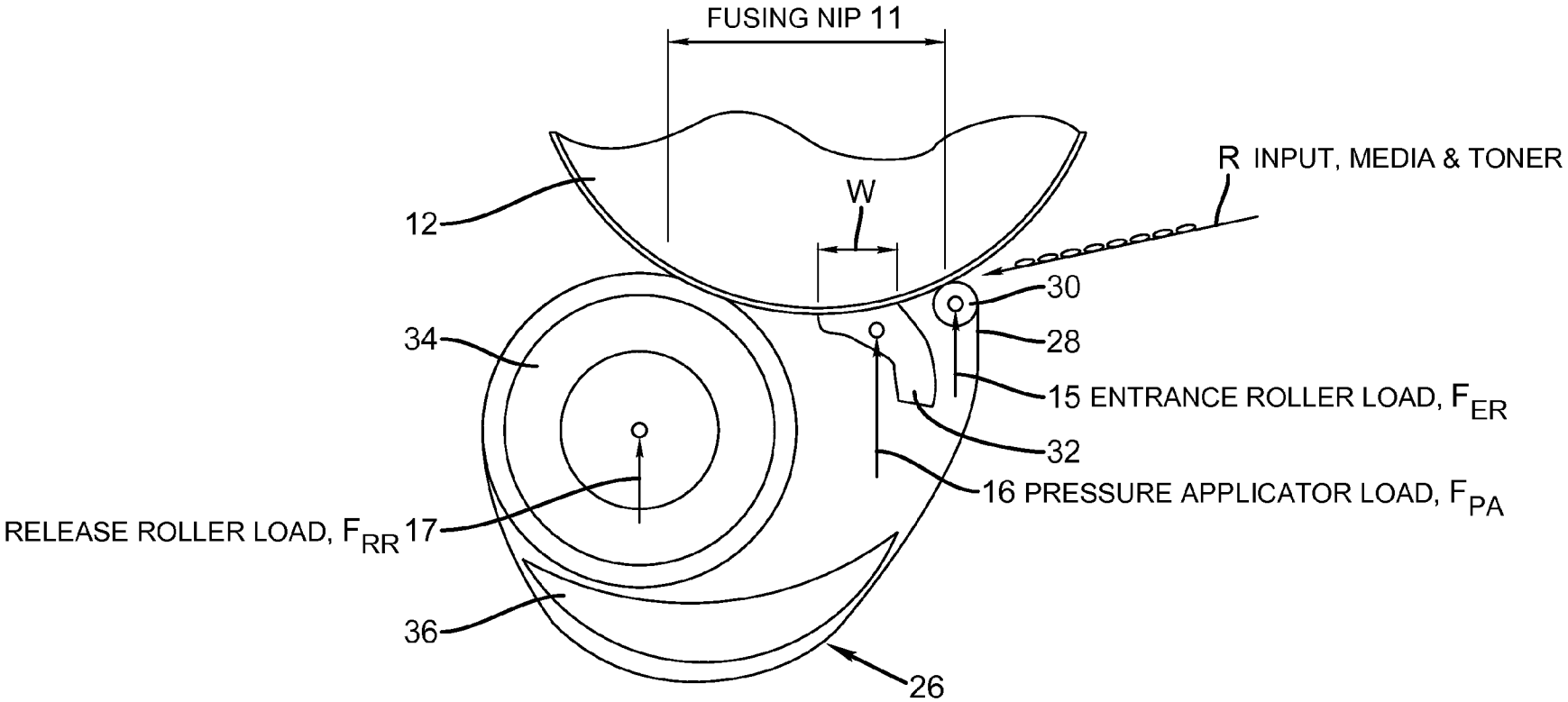
FIG. 4 shows the applied pressure forces for the fuser device of FIG. 1.
Figure 5:
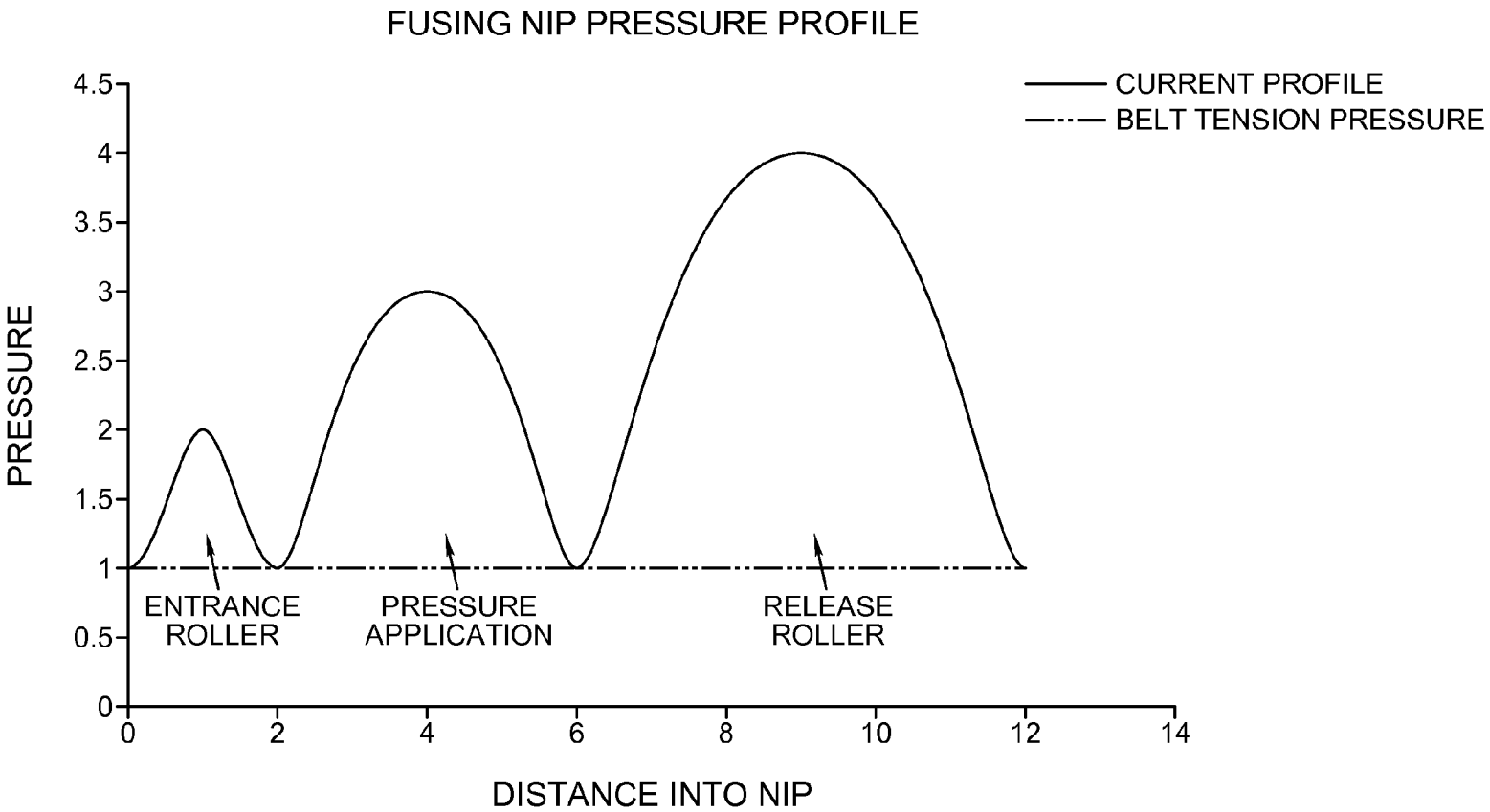
FIG. 5 is a graphical representation of a fusing nip pressure profile a fuser device according to this invention.
Figure 6:
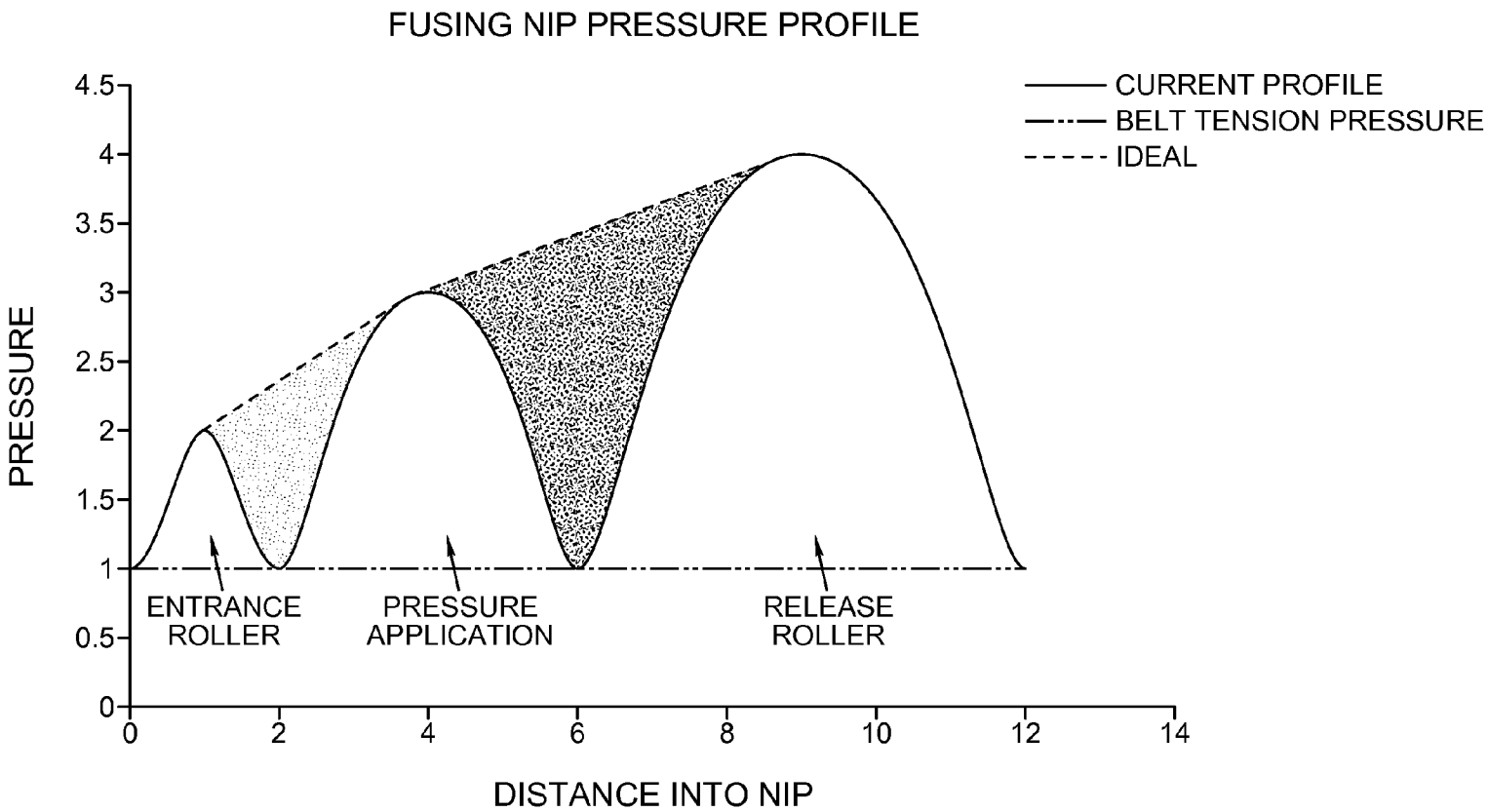
FIG. 6 is a graphical representation of the fusing nip pressure profile for a fuser device as shown in FIG. 5, including the ideal pressure profile.

For pressure application in the fusing nip 24, four elements are used to back up the pressure film belt 28: the entrance roller 30, the pressure applicator 32, the exit roller 34, and a tracking structure 36. The tracking structure 36 supports the pressure film belt 28 between the exit roller 34 and the entrance roller 30. It can also be used to control tension in the pressure film belt 28 in any well known manner. Having these pressure inducing parts creates three pressure pulses through the fusing nip 24 (see FIG. 4). While a continuous pressure throughout the fusing nip would be optimum, it is not practical. Therefore, minimizing the loss in pressure between the components is done to optimize the pressure profile in the fusing nip. FIG. 4 shows each of the three mentioned pressure parts through the fusing nip 24 with their respective applied forces: entrance roller load $F_{ER}$, pressure applicator load $F_{PA}$, and the exit roller load $F_{RR}$. FIG. 5 shows a pressure profile for the fusing nip of this configuration. FIG. 6 shows the same pressure profile while indicating the ideal (optimum) pressure profile. The minimum pressure between each part is equal to the pressure applied by the pressure film belt 28. The amount of pressure that the pressure film belt 28 applies is proportional to the tension in the pressure film belt established by the elements used to back up the pressure film belt.

The shape, stiffness, and load $F_{PA}$ of the pressure applicator 32 determines the pressure profile for a given fuser roller configuration. The pressure applicator 32 of this embodiment is made of metal and acts as a rigid member. The shape is curved to approximately match the outer curvature of the fuser roller 12 in the compressed (loaded) state. The width W of the pressure applicator 32 is as close as possible to the width of the entrance roller 30 and the exit roller 34, without contact.

Figure 7:
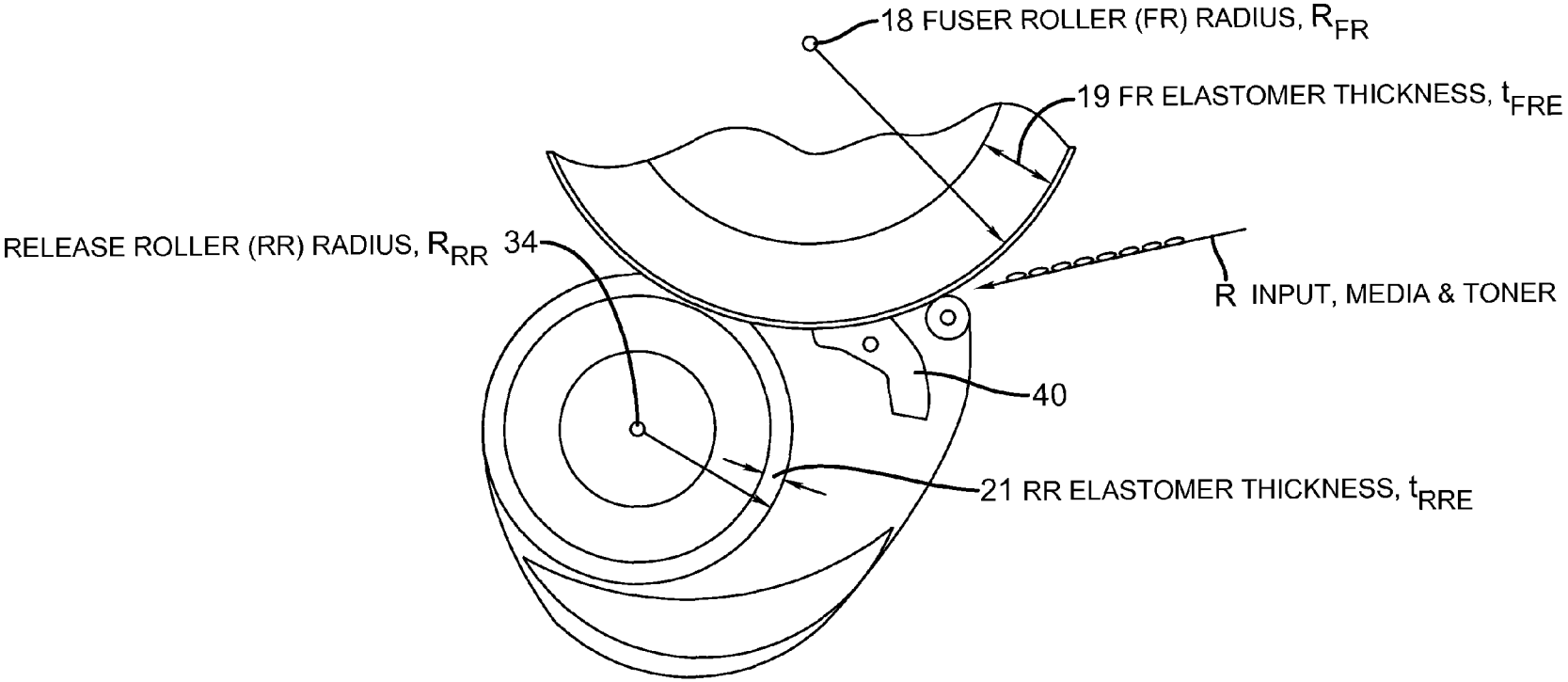
FIG. 7 shows another embodiment of the fuser device according to this invention.
Figure 8:
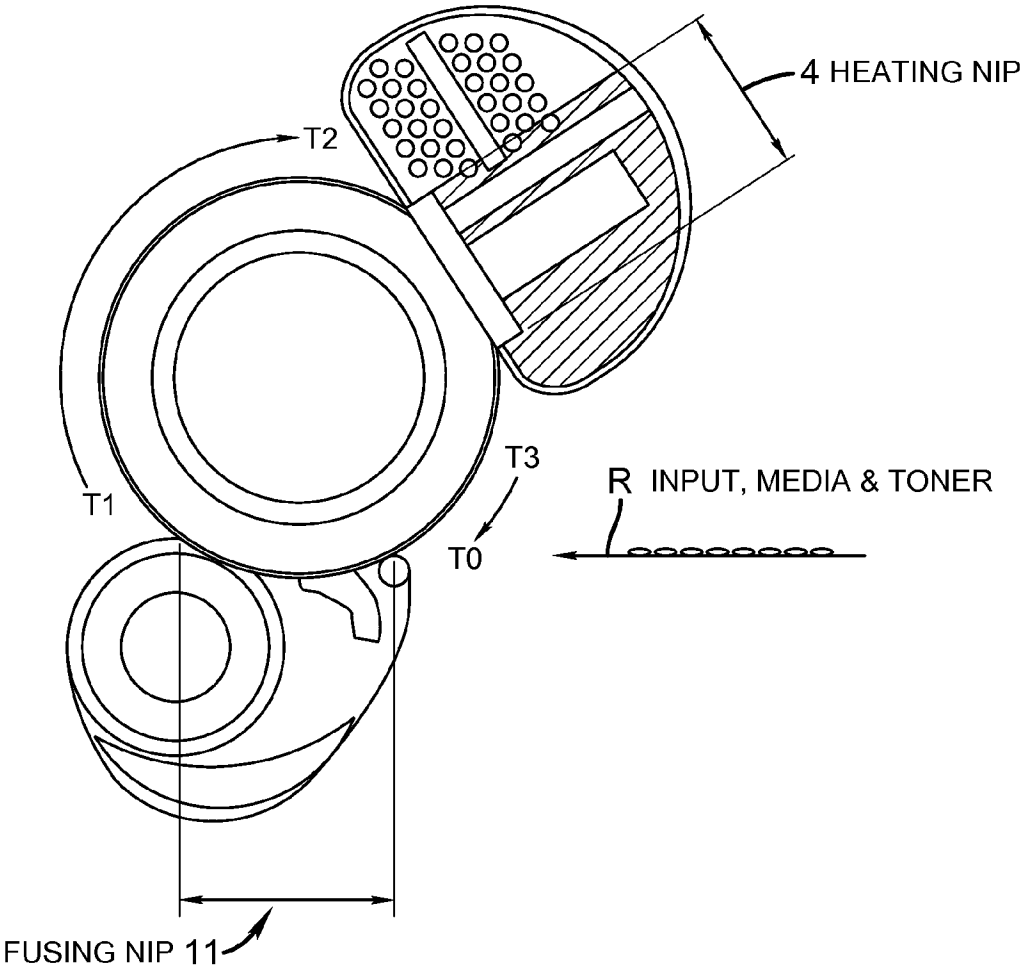
FIG. 8 shows the temperature points around the fuser roller for the fuser device of FIG. 7.

In an alternate embodiment shown in FIG. 7, the pressure applicator, designated by the numeral 40, is made of an elastomeric material, such as silicone rubber. The geometrical shape of the elastomeric pressure applicator 40 is configured to provide the broadest pressure profile result. FIG. 8 shows the temperature points around the fuser roller for the fuser device of FIG. 7.

The invention has been described in detail with particular reference to certain preferred embodiment thereof, but it will be understood that variations and modifications can be effected within the spirit and scope of the invention.

PARTS LIST

10 fuser device
12 fuser roller
14 external heater assembly
16 fuser roller elastomeric cover
18 metal film belt
18' tracking structure for the metal film belt
20 heating element
20' heating nip
22 release layer
24 fusing nip
26 pressure film assembly
28 pressure film belt
30 entrance roller
32 pressure applicator
34 exit roller
36 tracking structure for pressure film belt
40 alternate pressure applicator

What is claimed is:

1. A fuser device for use in an electrostatographic reproduction apparatus, said fuser device comprising:

a fuser roller, said fuser roller having a thick elastomeric cover;

an external heater assembly, in operative association with said elastomeric cover of said fuser roller, said external heater assembly having a shaped tracking structure for an endless metal film defining a heating nip between the fuser roller and the endless metal film and a heating element to transfer heat rapidly to the endless metal film and to pressure the endless metal film against the external surface of said elastomeric cover of said fuser roller so that heat from the endless metal film diffuses into the elastomeric cover; and a pressure film belt assembly, including an endless pressure film belt in operative association with said fuser roller and spaced from said external heater assembly, and wherein said pressure film belt assembly has a pressure applicator which applies thermal contact and mechanical energy to define a nip pressure profile providing an extended fusing nip for said endless pressure film belt with said fuser roller, wherein the endless metal film has a thermal time constant that is less than a millisecond, so that temperature control for said fuser roller can be adjusted to provide a fusing temperature that provides high image quality for photos, text, and graphics for high quality reproductions with a determined gloss and wherein said pressure film belt assembly further includes an entrance roller, an exit roller, and the pressure applicator located with said pressure film belt to back up the pressure film belt assembly, wherein the pressure applicator is curved to approximately match the outer curvature of said cover of said fuser roller in the compressed, loaded state and a shape, stiffness, and load of the pressure applicator determines a pressure profile for a given fuser roller configuration.

2. The fuser device of claim 1, wherein said external heater assembly includes an endless metal film belt is a Nickel film belt.

3. The fuser device of claim 2 wherein said heating element is a metal resistance trace embedded in a ceramic substrate operating on the Joule heating principle such that heat transfer to said fuser roller elastomeric cover is purely diffusive.

4. The fuser device of claim 1, wherein said pressure applicator is made of an elastomeric material, such as silicone rubber, and a geometrical shape of said elastomeric pressure applicator is configured to provide the broadest pressure profile result.

* * * * *